US007764893B2

(12) United States Patent
Banton et al.

(10) Patent No.: US 7,764,893 B2
(45) Date of Patent: Jul. 27, 2010

(54) USE OF CUSTOMER DOCUMENTS FOR GLOSS MEASUREMENTS

(75) Inventors: Martin Edward Banton, Fairport, NY (US); Dale R. Mashtare, Bloomfield, NY (US); Paul A. Hosier, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 275 days.

(21) Appl. No.: 12/023,306

(22) Filed: Jan. 31, 2008

(65) Prior Publication Data

US 2009/0196641 A1 Aug. 6, 2009

(51) Int. Cl.
*G03G 15/20* (2006.01)

(52) U.S. Cl. ..... 399/67

(58) Field of Classification Search ..... 399/38, 399/47, 67, 68, 69, 15, 341
See application file for complete search history.

(56) References Cited

U.S. PATENT DOCUMENTS 4,945,253 A * 7/1990 Frohardt ..... 250/559.16
5,101,285 A 3/1992 Kawai et al.
5,162,874 A 11/1992 Butler
5,204,538 A 4/1993 Genovese
5,555,084 A 9/1996 Vetromile et al.
5,556,529 A 9/1996 Nemoto
5,654,799 A * 8/1997 Chase et al. ..... 356/600
5,748,221 A 5/1998 Castelli et al.
5,751,432 A 5/1998 Gwaltney
6,016,204 A 1/2000 Budnik et al.
6,240,205 B1 5/2001 Fan et al.
6,242,145 B1 * 6/2001 Galloway et al. ..... 430/114
6,294,327 B1 9/2001 Walton et al.
6,347,153 B1 2/2002 Triplett et al.
6,526,250 B1 2/2003 Usui et al.
6,975,949 B2 12/2005 Mestha et al.
7,024,152 B2 4/2006 Lofthus et al.

(Continued)

OTHER PUBLICATIONS

Anni Berger-Schunn, Practical Color Measurement: A Primer for the Beginner, a Reminder for the Expert, Wiley Series in Pure and Applied Optics, authorized translation of the German edition published by John Wiley & Sons, Inc., 1994, 175 pp.

(Continued)

*Primary Examiner*—David P Porta
*Assistant Examiner*—Kiho Kim
(74) *Attorney, Agent, or Firm*—Pillsbury Winthrop Shaw Pittman LLP

(57) ABSTRACT

An image printing system for adjusting gloss on printed documents includes a marking engine constructed to print images, which have gloss, on a document; a gloss measurement device, includes a linear array sensor to detect a generally specular and diffuse reflectance in the first direction produced by one or more illuminators; a processor configured to receive image data relating to a content of the image to be printed on the document; to process the detected generally specular and diffuse reflectances to determine a characteristic of the gloss of the document, and to compare the gloss characteristic with the image data relating to content of the image printed on the document; and a controller configured to control at least one process controls parameter of the marking engine based on the comparison of the gloss characteristic with the image content by the processor.

28 Claims, 5 Drawing Sheets

U.S. PATENT DOCUMENTS

| | | | | |
|---|---|---|---|---|
| 7,136,616 | B2 | 11/2006 | Mandel et al. | |
| 7,324,241 | B2 | 1/2008 | Eschbach et al. | |
| 2003/0127006 | A1 | 7/2003 | Majewicz et al. | |
| 2003/0128362 | A1 | 7/2003 | Gudaitis et al. | |
| 2004/0001233 | A1 | 1/2004 | Wang et al. | |
| 2004/0141764 | A1 | 7/2004 | Runkowske et al. | |
| 2005/0083530 | A1 | 4/2005 | Ogihara et al. | |
| 2005/0092724 | A1 | 5/2005 | Warren, Jr. et al. | |
| 2005/0200866 | A1* | 9/2005 | Hoshii et al. | 358/1.9 |
| 2005/0201223 | A1* | 9/2005 | Bolash et al. | 369/44.27 |
| 2006/0023266 | A1 | 2/2006 | Ohara | |
| 2006/0046180 | A1 | 3/2006 | Sanders et al. | |
| 2006/0092412 | A1* | 5/2006 | Doshoda et al. | 356/243.1 |
| 2006/0110009 | A1 | 5/2006 | Klassen et al. | |
| 2006/0222384 | A1 | 10/2006 | Moore et al. | |
| 2007/0003302 | A1 | 1/2007 | Mizes | |
| 2007/0140571 | A1 | 6/2007 | Fan et al. | |
| 2008/0173799 | A1 | 7/2008 | Herloski et al. | |
| 2008/0245979 | A1 | 10/2008 | Banton et al. | |
| 2008/0291507 | A1 | 11/2008 | Rodrigues et al. | |

OTHER PUBLICATIONS

Edul N. Dalal et al., "The Effect of Gloss on Color," Color Research and Application, Wiley InterScience, vol. 24, No. 5, Oct. 1999, pp. 369-376.

John C. Briggs et al., "The Effect of Fusing on Gloss in Electrophotography," IS&T's NIP14 International Conference on Digital Printing Technologies, Oct. 18-23, 1998, Toronto, Ontario, Canada, 6 pp.

* cited by examiner

USE OF CUSTOMER DOCUMENTS FOR GLOSS MEASUREMENTS

BACKGROUND

1. Field

This present disclosure relates to a system and a method for adjusting gloss on printed documents.

2. Description of Related Art

In a printing system where multiple marking engines are used to print a job, consistency in image quality produced by the individual marking engines that are used to produce a given document is a central issue. It is important that the level of gloss be essentially the same, even though the pages (often it will be multiple copies of the same page) are printed on different marking engines. And, in systems with only one marking engine, it is important that gloss be uniform over a page.

U.S. Pat. No. 5,748,221, herein incorporated by reference, discloses measuring in situ color, gloss and registration, but at low resolution and at only one place in the process direction.

Maintenance of gloss is an important part of achieving image quality consistency (IQC). Gloss performance is influenced by the media weights and types that are in the job/jobs being printed. Determining whether the gloss performance has changed after a series of heavier weight documents generally requires the printing of test patterns which negatively affect productivity and be intrusive to the customer.

The inventors have recognized that it would be desirable to provide a print quality control system for verifying the accuracy of a printing process, where the measurement of the print quality is obtained by comparing the gloss.

SUMMARY

In an embodiment, an image printing system is configured for adjusting gloss on printed documents. The system includes a marking engine, a gloss measurement device, a processor and a controller. The marking engine is constructed to print images on a document, where the printed images have gloss. The gloss measurement device includes one or more illuminators and a linear array sensor. The one or more illuminators are configured to emit one or more light beams at the printed document, thereby producing generally specular reflectance and generally diffuse reflectance at least in a first direction. The linear array sensor is configured to detect the generally specular reflectance and the generally diffuse reflectance in the first direction. The processor is configured to receive image data relating to a content of the image to be printed on the document; to process the detected generally specular and diffuse reflectances to determine a characteristic of the gloss of the document, and to compare the gloss characteristic with the image data relating to content of the image printed on the document. The controller configured to control at least one process controls parameter of the marking engine based on the comparison of the gloss characteristic with the image content by the processor.

In another embodiment, a method for adjusting gloss on printed documents is provided. The method includes printing images on a document using a marking engine, where the printed images have gloss; providing a gloss measurement device; configuring one or more illuminators of the gloss measurement device to emit one or more light beams at the printed document, thereby producing generally specular reflectance and generally diffuse reflectance at least in a first direction; configuring a linear array sensor to detect the generally specular reflectance and the generally diffuse reflectance in the first direction; providing a processor configured to receive image data relating to a content of the image to be printed on the document; to process the detected generally specular and diffuse reflectances to determine a characteristic of the gloss of the document; and to compare the gloss characteristic with the image data relating to content of the image printed on the document; and providing a controller configured to control at least one process controls parameter of the marking engine based on the comparison of the gloss characteristic with the image content by the processor.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

The application is related to application Ser. No. 11/783,174, which is incorporated herein by reference.

The law of reflection states that the direction of outgoing reflected light and the direction of incoming light make the same angle with respect to the surface normal. Specular reflection is the perfect, mirror-like reflection of light from a surface, in which light from a single incoming direction is reflected into a single outgoing direction. In contrast, diffuse reflection is reflection of light from a surface, in which light from a single incoming direction is reflected in many directions, due to surface irregularities that cause the rays of light to reflect in different outgoing directions. The type of reflection depends on the structure of the surface. For example, while both matte and glossy prints exhibit a combination of specular and diffuse reflection, matte prints have a higher proportion of diffuse reflection and glossy prints have a greater proportion of specular reflection.

An image analysis software, which determines the image content of printed customer documents is combined with a gloss measurement device 25, which determines the surface characteristic of the gloss of the document to enable an image printing system 200 to evaluate print engine performance in real time using customer documents so there is no impact on productivity or perceived obtrusiveness by a user. The specular and the diffuse reflectances determined from the gloss measurement device 25 can be compared to the content of the image to be printed on the document (i.e., the electronic image data). The comparison of the measured gloss pattern from the gloss measurement device 25, to the image content of the document closes a loop and enables identification of whether or not the gloss is as uniform as it should be.

The present disclosure relates to the image printing system 200 in which gloss measurements can be made using printed customer documents whenever a customer document has image content that is appropriate for scanning for gloss information. These gloss measurements can be used by the print engine to maintain gloss at the desired level or to raise an alert or flag that gloss is out of the desired range. An image content analyzer determines whether the image content in any customer document will, when scanned, provide information useful by the print engine controller.

The image printing system 200 may be used in different applications such as, for example, xerographic systems with and without gloss coating capability, solid ink jet printing systems, and ink jet printing systems where all three types of printing system may be capable of adding a gloss coat.

Figure 1:
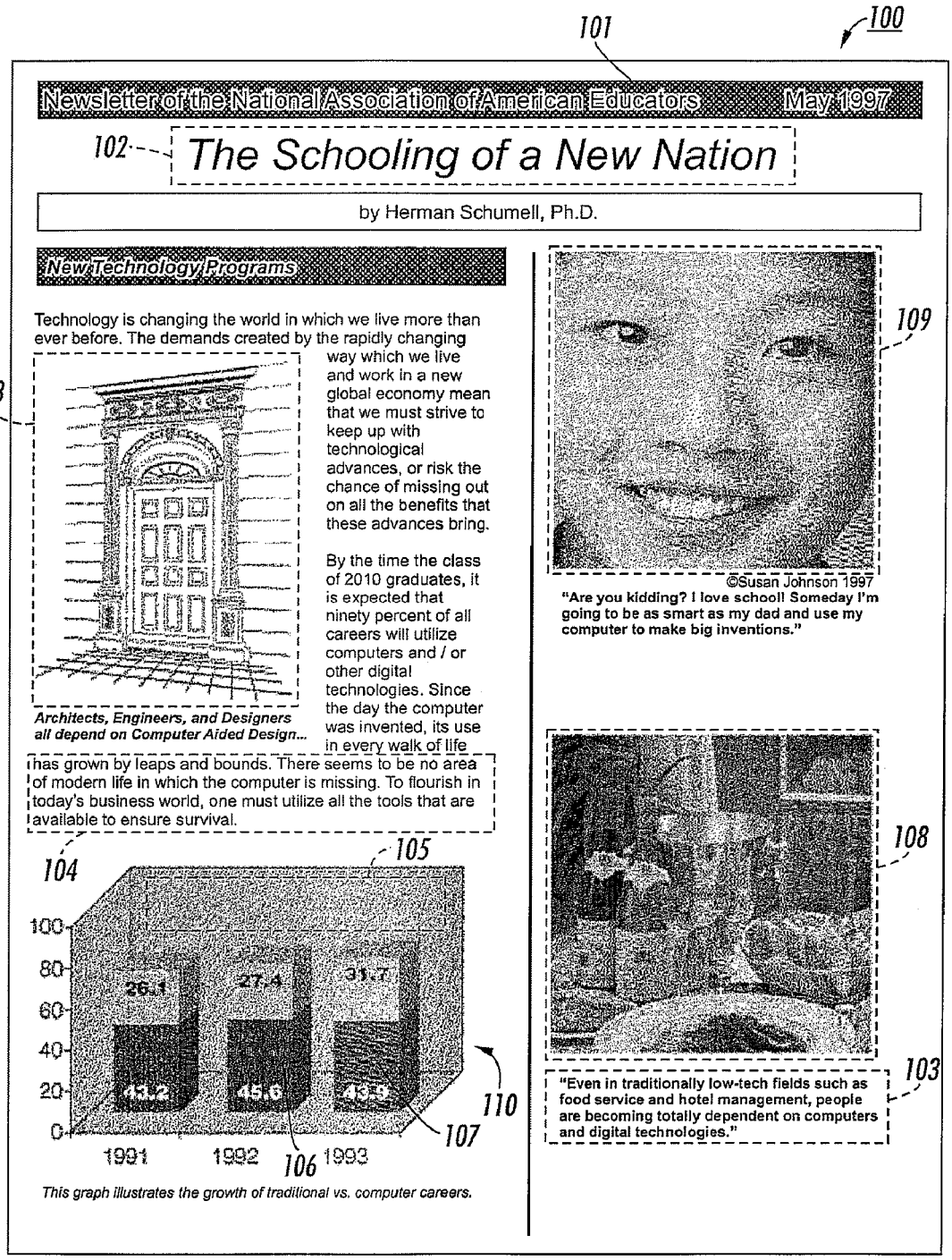
FIG. 1 shows an example of how knowledge of the image content of the image on a document can be used to diagnose operation of a fusing subsystem.

FIG. 1 shows example of how knowledge of the image content can be used to diagnose operations of a fusing subsystem. Image content is often stored in the form of image data files comprising multiple scanlines, each scanline comprising multiple pixels. When processing this type of image content, it is helpful to know the type of image represented by the content. For instance, the image content could represent graphics, text, a halftone, contone, or some other recognized image content type. A document of image content could be all one image content type, or some combination of different image content types. An exemplary document 100 is illustrated having various image content types. For example, the document 100 may have one or more of the following, black solid 101; colored text 102; black lines 103; black text 104; areas of constant halftone 105; saturated colors 106, 107; halftones 108, 109; and substrate 110.

Various image content types present in the customer documents can be determined by the image analysis software using algorithms. For example, algorithms that identify the image content types of a document are disclosed in U.S. Pat. Nos. 6,240,205 B1; 6,347,153 B1 and U.S. Patent Application Publication 2007/0140571 A1, herein incorporated by reference.

The knowledge of the image content obtained from different image content types (e.g., solids (saturated colors), halftone regions, or substrate) of the customer documents also enables the analysis of differential gloss levels occurring for the customer document. The use of the various image content present in customer images enables one to assess the absolute gloss levels achieved with present engine state, enabled with calibration of the gloss measurement device 25 in the image printing system 200.

Figure 2:
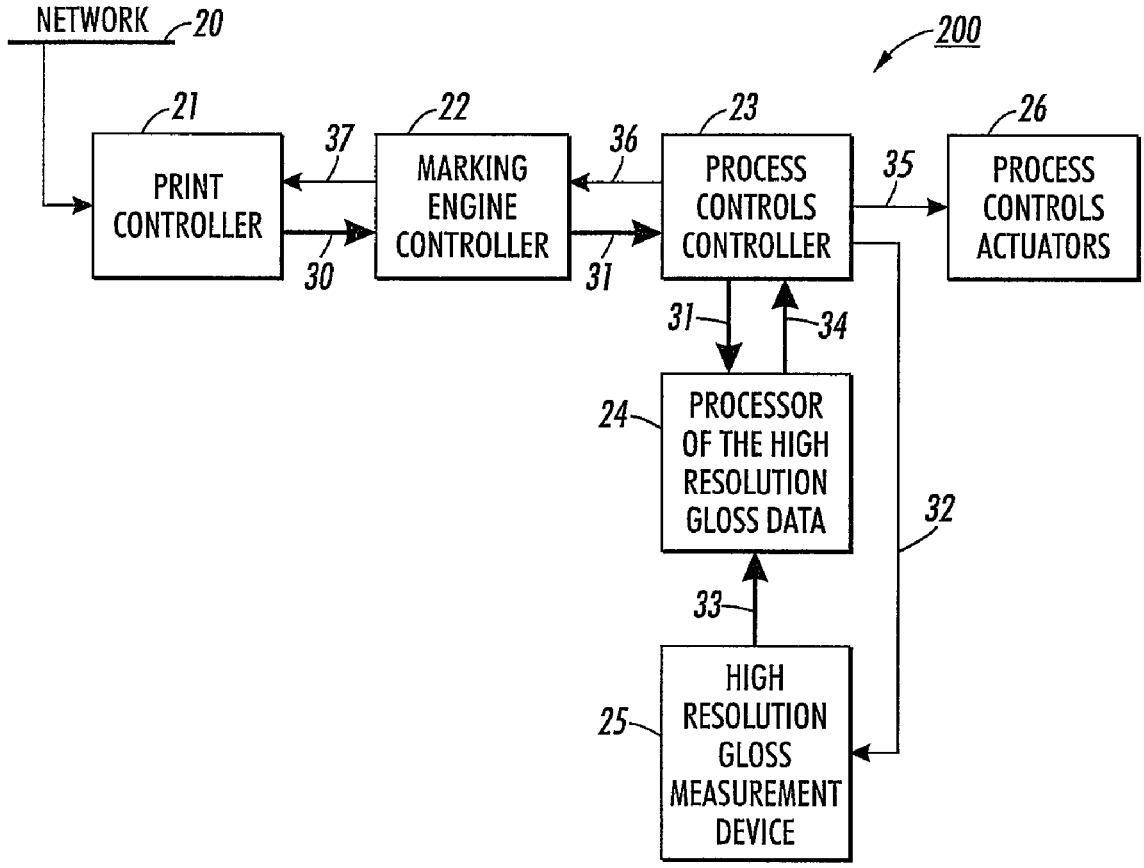
FIG. 2 shows an embodiment of an image printing system that uses high resolution gloss measurements and knowledge of type and locations of various object types on a document.

FIG. 2 shows the architecture of the image printing system 200. The combination of the high resolution gloss measurement device 25 and the image analysis software in the image printing system 200 enables the printed customer documents to be used to determine the gloss performance of the fusing system(s) of the print engine. The image printing system 200 uses high resolution gloss measurements and knowledge of the type and locations of various object types on a document to produce gloss values that are consistent and within specification. The image printing system 200 includes a print controller 21, a marking engine controller 22, the high resolution gloss measurement device 25, a high resolution gloss data processor 24, a process controls controller 23, and plurality of process controls actuators 26.

In an embodiment, the user may input a desired gloss, for e.g., high, medium or low gloss, using an user interface. For example, a desired gloss can be input to the image printing system 200 as part of a job ticket bearing the gloss information, for e.g., uniform high gloss or uniform medium gloss. Alternatively, in one embodiment, the original customer document can be scanned to provide desired gloss information.

In one embodiment, the print controller 21 is used to manage print devices especially in high-volume environments, e.g., color laser printers, production printers, and digital presses. In one embodiment, the print controller 21 is a Digital Front End (DFE). Image content in digital forms (i.e., a data file) is accepted, stored, produced, decomposed or otherwise presented at the print controller 21. print controller 21 accepts content for images desired to be printed in any one of a number of possible formats, such as, for example, TIFF, JPEG, or Adobe® PostScript™. This image content is then "interpreted" or "decomposed" in a known manner into a format usable by the marking engine controller 22. The print controller 21 increases productivity by efficiently automating digital workflow. Typically, the print controller 21 is an external device, such as a computer or server, that interfaces to a network 20 and typically will accept image content and process the image content for a copier or printer devices. However, the print controller 21 could be a part of the printing device itself. For example, the Xerox® iGen3™ digital printing press incorporates a print controller. By having knowledge of each pixel individually, the print controller 21 can process each pixel of the image content more intelligently.

In an embodiment, the print controller 21 receives the image content for the customer documents via the network 20. The print controller 21 identifies the objects types and their locations on the customer documents that will be printed. The object types and their locations on the customer documents can be identified by the print controller 21 using image analysis software, as described in detail above. The print controller 21 sends both the image data 30 from the image, and the identified object types and their locations data 30 to the marking engine controller 22. Once the data 30 is received by the marking engine controller 22, the print controller 21 receives a handshake signal 37 from the marking engine controller 22 confirming that the data 30 is received and the marking engine controller 22 is ready for accept the next packet of data 30.

In other embodiments (not shown), the image content that is passed through the print controller 21 directly to the print engine or it may be sent to the print engine directly. All of this depends in the architecture of the printer and/or print controller.

Disposed about a photoreceptor are various xerographic subsystems, including a cleaning device or station, a charging station, an exposure station, which forms a latent image on the photoreceptor, a developer for developing the latent image by applying a toner thereto to form a toner image, a transferring unit, such as a transfer corotron, which transfers the toner image thus formed to the print media, and a fuser, which fuses the transferred image to the print media. These xerographic subsystems are controlled by a marking engine controller 22, such as a CPU. Though the marking engine controller 22 of the illustrated embodiment is schematically shown as a single unit, it is to be appreciated that the marking engine controller 22 can be distributed throughout a marking engine module, which includes hardware elements or components-employed in the creation of desired images by electrographical processes, and formed of multiple remotely positioned components. For example, actuators forming the marking engine controller 22 can be located in or on the xerographic subsystems and thus the marking engine controller 22 is not necessarily physically removed from or separate from other elements of the marking engine module.

The marking engine controller 22 controls a marking engine, which is constructed to print images on a document where the printed image has gloss. The marking engine controller 22 receives from the print controller 21 both the image data 30 from the customer documents, and the object types and their locations data 30 on the customer documents that will be printed. The marking engine controller 22 sends the locations of the objects data 31 on the customer documents to the process controls controller 23.

Figure 4:
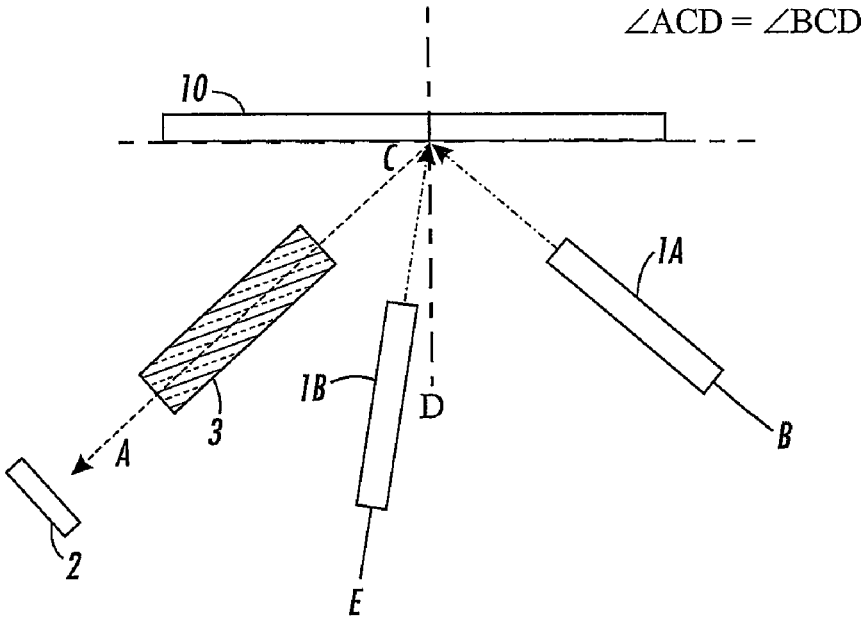
FIG. 4 shows an embodiment of gloss measurement device having two illuminators and one sensor, where the illuminators are arranged on the same side of the sensor.
Figure 5:
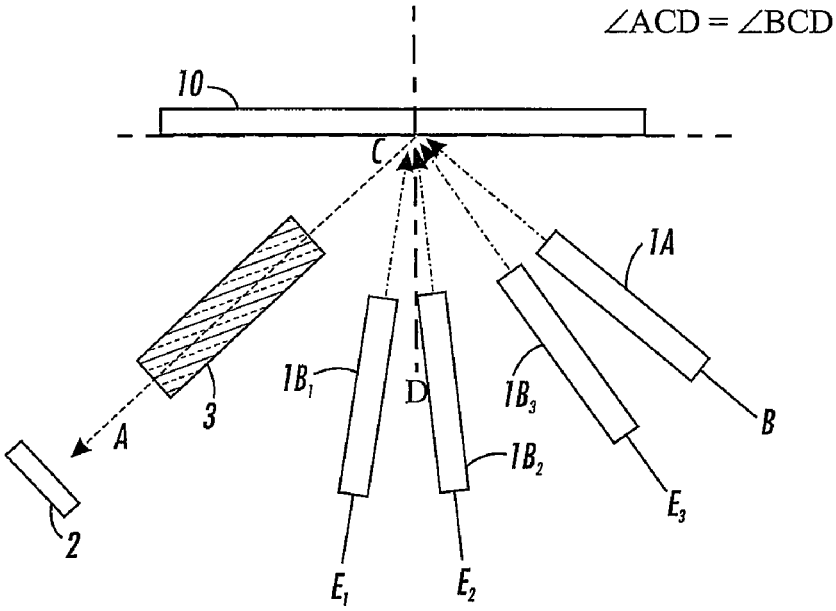
FIG. 5 shows an embodiment of gloss measurement device having at least three illuminators and one sensor.

The high resolution gloss measurement device 25 is provided for gloss sensing and for measuring the spatial dependence of gloss. In one embodiment, the gloss measurement device 25 is positioned downstream of the marking engine. In another embodiment, the gloss measurement device 25 can be a part of the marking engine. Advantageously, the device 25 is configured to capture high spatial resolution that is available in both the process and cross-process (or fast scan) directions. In a first embodiment, as shown in FIGS. 3-5, the device 25 includes at least two separate illuminators 1A and 1B in conjunction with a sensor 2.

Preferably, the sensor 2 is a linear array sensor, for example, a full width array (FWA) sensor. A full width array sensor is a sensor that extends substantially an entire width (perpendicular to a direction of motion) of the moving target, such as a photoreceptor. The full width array sensor may be disposed downstream of an associated marking engine in the printing process so that it can detect any desired part of the printed image without the need for test patches. That is, the sensor is positioned to sense the printed documents themselves. A full width array sensor may include a plurality of sensors equally spaced at intervals (e.g., every 1/600th inch (600 spots per inch)) in the cross-process direction. See for example, U.S. Pat. No. 6,975,949, incorporated herein by reference. It is understood that other linear array sensors may also be used, such as contact image sensors, CMOS array sensors or CCD array sensors.

Figure 8:
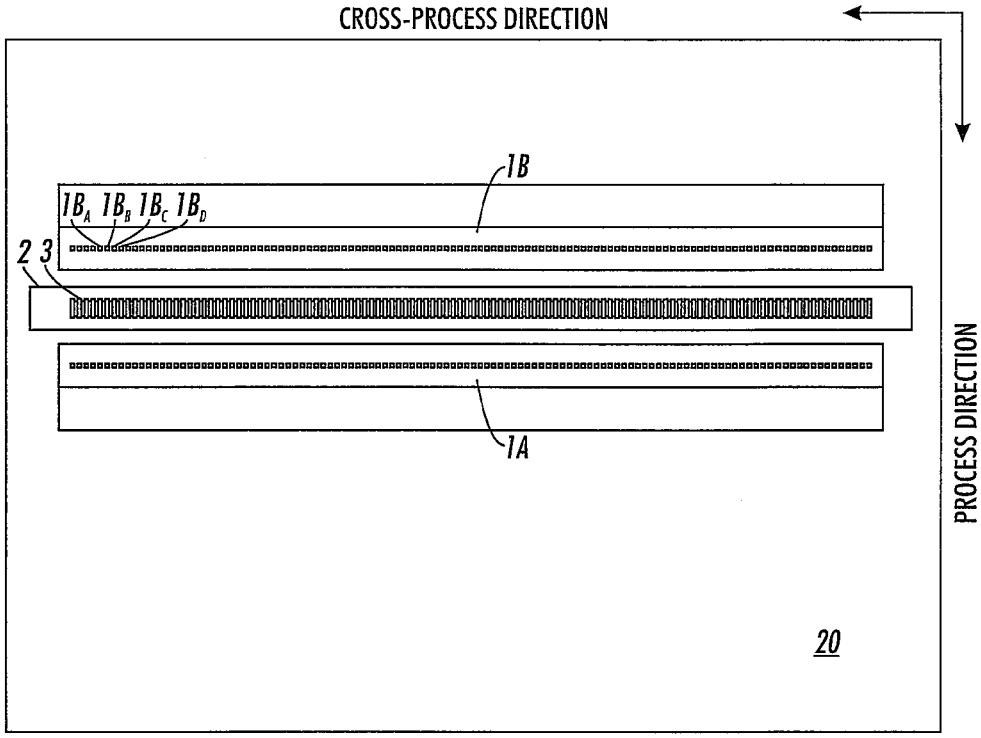
FIG. 8 shows an embodiment configured to capture high spatial resolution in both the process and cross-process directions.

The sensor 2 is configured to detect the reflectance of light from a generally smooth and flat surface of a target 10. The target 10 may preferably be any printing or scanning surface. Line C-D represents a normal line to the surface at a point C of the target 10. Point C may actually be a line or region on the surface of the target (for example as shown in FIG. 8).

Figure 3:
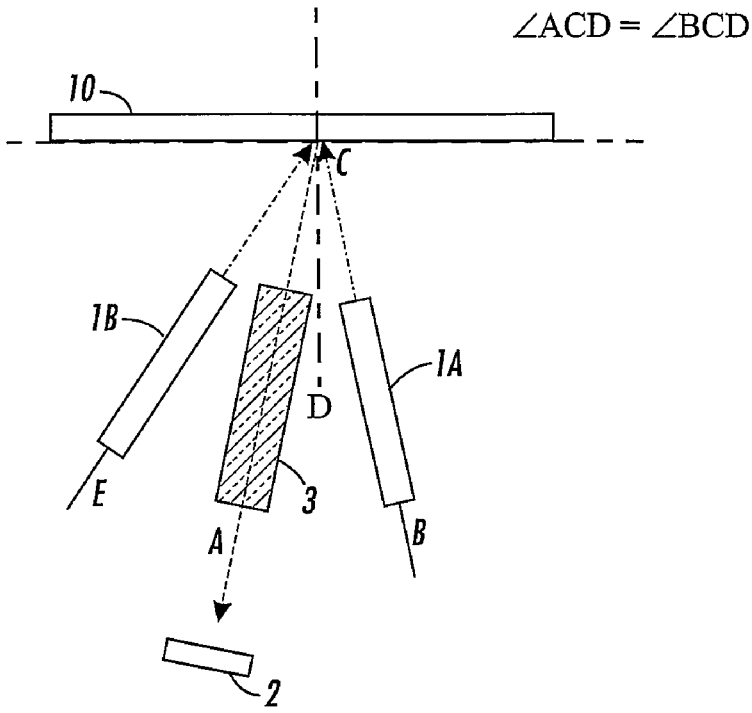
FIG. 3 shows an embodiment of gloss measurement device having two illuminators and one sensor, where the illuminators are arranged on opposite sides of the sensor.

In FIG. 3, the first illuminator 1A is located on a line B-C, while the second illuminator 1B is located on a line E-C. The angle (∠ACD) between lines A-C and D-C is set to be substantially equal to the angle (∠BCD) between lines B-C and C-D, such that the first illuminator 1A is configured to emit a light beam onto the target 10 at point C, thereby producing a generally specular reflectance from the target in a first direction along line A-C.

The angle (∠ECD) between lines E-C and D-C is set to be some angle other than the angle (∠ACD) between lines A-C and D-C, such that the second illuminator 1B is configured to emit a light beam onto the target 10 at point C, thereby producing some generally diffuse reflectance in at least the first direction along line A-C.

The sensor 2 is located along a line A-C, such that it captures the generally specular reflectance from the first illuminator 1A, as well as, some of the diffuse reflectance from the second illuminator 1B, both reflected from point C of the target 10 in the first direction. Because the surface of the target 10 will never be a "perfect mirror," the specular reflectance from the beam of illuminator 1A along line A-C will also include some (albeit a small fraction of) diffuse reflectance from the beam of illuminator of 1A.

The illuminators 1A, 1B are implemented as light sources. Preferably, a linear LED array may be used in conjunction with the linear array sensor 2, as disclosed, for example, in U.S. Pat. No. 6,975,949, previously mentioned above. The linear LED array could also use just one row of LEDs. The combination of a linear array sensor and linear LED array allows for high spatial resolution (e.g., 600 spi) in both the process and cross-process directions. The LED arrays could be all one color, e.g., white or of multiple colors, as described in U.S. Pat. No. 6,975,949. Also, the illuminators may be lamps, or may consist of a lamp on side of the linear array sensor and a reflector on the other side. A collimated light beam may yield a greater of ratio of specular reflectance.

It may be possible to have the two illuminators 1A, 1B emit light with different spectral content, should that be desirable. If the illuminators 1A, 1B consist of red, green and blue LEDs, the spectral content could be tailored in the field to the application at hand.

The illuminators can be turned on and off in a time that is less than or equal to a line time for a predetermined spatial resolution in the process direction. It is likely that one of the illuminators, for example, the diffuse illuminator 1B may be left on and only the specular illuminator 1A is pulsed on and off. The types of illuminators may be different, for example, the illuminator used for the specular reflectance could be a lamp while the illuminator used for the diffuse reflectance could consist of a red, green, blue and other color LEDs.

Two embodiments relying on two illuminators 1A, 1B and one sensor 2 with a Selfoc® lens 3 are shown in FIGS. 3 and 4. The key difference between the embodiments shown in FIGS. 3 and 4 is in the placement of the two illuminators 1A, 1B relative to the sensor 2. In FIG. 3 the two illuminators 1A, 1B are on opposite sides of the sensor 2. In contrast, in FIG. 4 the illuminators 1A, 1B are both on the same side of the sensor 2.

A cylindrical lens arrangement (not shown) may also be placed in the optical path of the specular illuminator 1A to minimize diffuse illumination, further reduced with baffles and/or field stops, along the illumination width. Ideally, collimation of the specular illuminator 1A may help to insure more sharply defined specular image capture.

The sampling of the sensor 2 may be synchronized to the illuminators 1A, 1B so that each scanline is alternately a capture of: 1) diffuse reflectance; and 2) the combination of specular and diffuse reflectances. For example, the two illuminators 1A, 1B can be pulsed on and off sequentially so that scanline N will be a capture of diffusely reflected light and scanline N+1 will be a capture of the combination of specularly and diffusely reflected light, thereby producing two images. Given a system capable of 600 scans per inch (spi) sampling in the process direction, the output would be two 300 spi images, one the combination of specular and diffuse reflection and one the diffuse reflection. From these images that have half the normal 600 spi resolution, a full resolution image for each of the two cases could be generated. It is likely that in many, if not for most of the applications, the fact that the two images are interdigitated will not introduce complications that require attention. In fact, low resolution scanning may even be an advantage, if the primary application is for gloss measurement uniformity. If the primary application is for gloss uniformity only, as is the case in the present disclosure, then the sensor 2 could likely work at a much lower resolution, e.g., 200 spi, 100 spi or even 50 spi.

Another control parameter in the high gloss measurement device 25 is how well the Selfoc® lens 3 is focused. It may be advantageous to operate the Selfoc® lens 3 out of focus, which can be easily implemented in providing a mechanism (not shown) for controlling the amount the Selfoc® lens is of out-of-focus. Thus, the focus can be changed and/or controlled in the printing system.

FIG. 5 shows an embodiment which uses at least three diffuse illuminators $\mathbf{1}B_1$, $\mathbf{1}B_2$, $\mathbf{1}B_3$ located along respective axes $E_1$-C, $E_2$-C, $E_3$-C. The angles ($\angle E_1CD$, $\angle E_2CD$, $\angle E_3CD$) between lines $E_1$-C, $E_2$-C, $E_3$-C and normal line D-C are set to be some angles other than the angle ($\angle ACD$) between lines A-C and normal line D-C, such that the multiple diffuse illuminators $\mathbf{1}B_1$, $\mathbf{1}B_2$, $\mathbf{1}B_3$ are each configured to emit a light beam onto the target 10 at point C, thereby producing some generally diffuse reflectance at least in a direction along line A-C.

Another embodiment (not shown), may be to have the angle for specular reflectance be variable by selecting one of a plurality of illuminators (for example as shown in FIG. 5), and changing the angle between the axis of the sensor and normal line to the surface of the target to match the angle between the axis of the selected illuminator and the normal line to the surface of the target. Further, the angle for diffuse reflectance could be variable also. The various angular relationships can be selectively adjusted by changing the angles of the sensor(s) and/or illuminator(s) with respect to the normal line, in order to change the angular dependence with respect to the specular and/or diffuse reflectances, should this be desirable.

Figure 6:
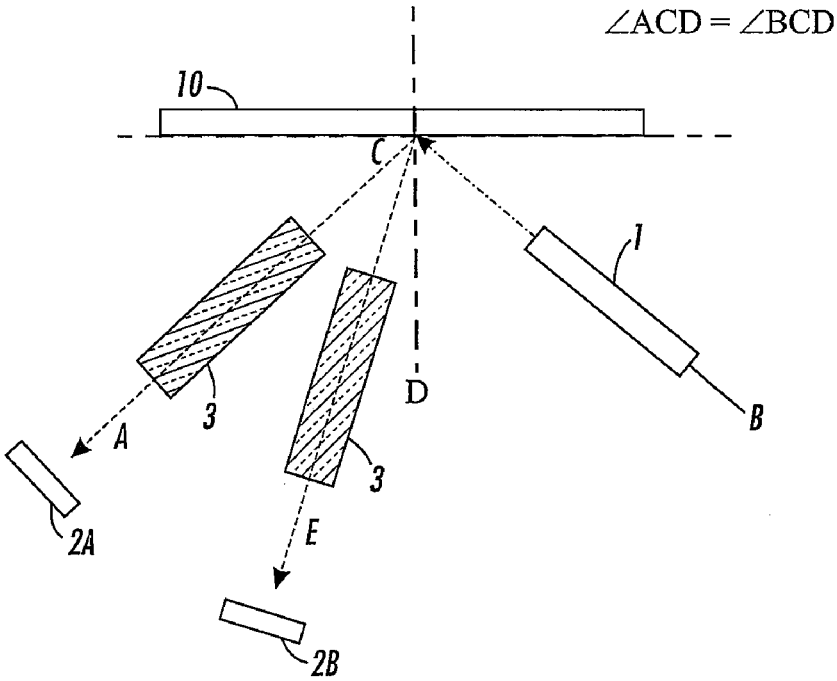
FIG. 6 shows an embodiment of gloss measurement device having one illuminator and two sensors.

Instead of using multiple illuminators 1A, 1B as shown in FIGS. 3-5, it may be also possible to configure a high resolution gloss measurement device with a single illuminator 1 and two sensors 2A, 2B, as shown in FIG. 6.

A single illuminator 1 is located on a line B-C and configured to emit a light beam onto the target 10 at point C, which is reflected, thereby producing generally specular reflectance in a first direction along line A-C, and some generally diffuse reflectance at least in a second direction, e.g., along line E-C. The angle ($\angle ACD$) between line A-C and normal line D-C is substantially equal to the angle ($\angle BCD$) between line B-C and normal line D-C. In contrast, the angle ($\angle ECD$) between line E-C and normal line D-C is some angle other than the angle ($\angle ACD$) between line A-C and normal line D-C.

A first sensor 2A is located along line A-C, such that it captures the generally specular reflectance in the first direction reflected from the target 10 at point C. A second sensor 2B is located along line E-C, such that it captures the diffuse reflectance in the second direction reflected from the target 10 at point C. This embodiment provides full resolution images for both types of reflected light. A calibration procedure could be determined so that the signals from the two separate sensors 2A, 2B can be used to work out the true specular reflectance and the difference between the specular and diffuse reflectances of the image being measured.

Figure 7:
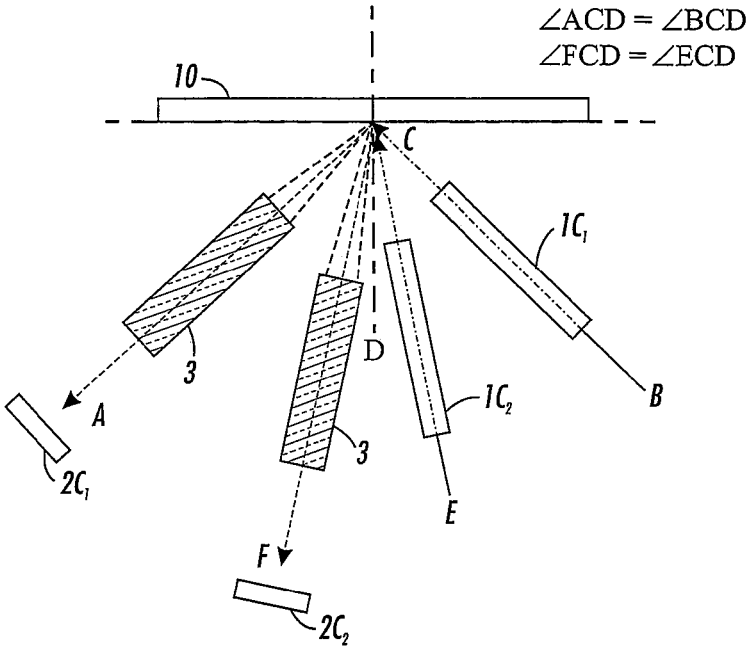
FIG. 7 shows an embodiment of gloss measurement device having two illuminators and two sensors.

This concept could be extended further, as shown in FIG. 7, to have two sensors $\mathbf{2}C_1$, $\mathbf{2}C_2$ located on lines A-C and F-C, respectively, and to have two illuminators $\mathbf{1}C_1$, $\mathbf{1}C_2$ located on lines B-C and E-C, respectively. The angle ($\angle ACD$) between lines A-C and D-C is set substantially equal to the angle ($\angle BCD$) between lines B-C and C-D; and the angle ($\angle ECD$) between lines E-C and D-C is set substantially equal to the angle ($\angle FCD$) between lines F-C and D-C. Angles ($\angle BCD$) and ($\angle ACD$) are not equal to angles ($\angle ECD$) and ($\angle FCD$). As such, the first sensor $\mathbf{2}C_1$ is in a position to capture the generally specular reflectance produced by the first illuminator $\mathbf{1}C_1$ and some generally diffuse reflectance produced by the second illuminator $\mathbf{1}C_2$. Similarly, the second sensor $\mathbf{2}C_2$ is in a position to capture the generally specular reflectance produced by the first illuminator $\mathbf{1}C_2$ and the some generally diffuse reflectance produced by the second illuminator $\mathbf{1}C_1$. This embodiment enables interdigitated capture of the generally specular and the generally diffuse reflectances produced by the two illuminators. Preferably, each illuminator produces different wavelengths, e.g., visible and infrared.

FIG. 8 shows an advantageous configuration for capturing high spatial resolution in both the process and cross-process (or fast scan) directions. The illuminators 1A, 1B may comprise two linear LED arrays, one configured to provide the generally specular illumination and the other to provide the generally diffuse illumination to the full width array sensor 2. (Note: FIG. 8 uses the embodiment of FIG. 3, however, it is understood that any of the embodiments disclosed herein may be used). The individual LEDs $\mathbf{1}B_A$, $\mathbf{1}B_B$, $\mathbf{1}B_C$, $\mathbf{1}B_D$, etc. of the LED arrays could be all of the same kind, or could be individually configured to produce different wavelengths or spectra, if this is desirable. By orienting the linear array sensor 2 in the cross-process direction, a high resolution measurement can be made over the entire width of target surface, e.g., a sheet of paper 20.

The high resolution gloss measurement device 25 may be used in conjunction with a tightly integrated parallel printing (TIPP) system, where multiple printing machines are controlled to output a single print job, as disclosed in U.S. Pat. Nos. 7,136,616 and 7,024,152, herein incorporated by reference. The high resolution gloss measurement device 25 may be configured to advantageously monitor fuser performance and match the performance of each of the multiple fusers in a TIPP system. Also, it can be used in overprinting in a TIPP system, for example as disclosed in U.S. Patent Application Publication No. 2006/0222384, herein incorporate by reference.

Tacking of the toned image can be accomplished by imparting only minimally incremental gloss to the toned regions as toner flows to promote tacking to the substrate. Having the ability to maintain the operation of the "tack" fusing is essential to control uniformity when marking on a page with more than one marking engine. In some of the TIPP systems a second fuser or FAP (Final Appearance and Permanence) station is used. The high resolution gloss measurement device 25 may also be used to determine if each marking engine is operating in an optimal manner. If the fusing done in each of the marking engines or in some of the marking engines is delivering output at some specified gloss level, it may be desirable not to use the FAP on those pages.

In another embodiment, the high resolution gloss measurement device 25 may also be used for scanning or reading (e.g., OCR) documents. This is especially true for the configuration shown in FIG. 3. In that case, the presence of the two illuminators 1A, 1B would help to minimize any shadowing at the edge of pages or paste-ups just like the use of an opposed reflector in copying applications where a sensor is used.

The high gloss measurement device 25 sends high resolution gloss data 33 to the processor 24 for further processing. The high resolution gloss data 33 comprises of both generally diffuse reflectance and generally specular reflectance, where the generally specular reflectance may comprise some diffuse reflectance.

The processor 24 for processing high resolution gloss data 33 is provided to both calibrate the sensor(s) and to process the reflectance data 33 detected by the sensor(s). It could be dedicated hardware like ASICs or FPGAs, software, or a combination of dedicated hardware and software. For the different applications the basic algorithm for extracting the specular and diffuse components may be the same but the analysis for the particular applications would vary.

It is possible to remove the diffuse reflectance from the combination of the specular and diffuse reflectance that is captured by the high resolution gloss measurement device 25. This allows for a more accurate measurement of the specular reflectance, exclusive of other factors (e.g., the opacity of the target surface, or stray light, etc.), which will be removed with the diffuse reflectance. Since considerable filtering is already used to lower resolution of the system to 300 spi versus the normal 600 spi, this should not introduce artifacts. It is possible that some of the applications above could be performed with specular only, but the measurement would be more accurate and the algorithms used to extract the measures desired would be easier and less likely to introduce errors with both specular and diffuse reflectance information available.

In one embodiment, the specular and the diffuse images can be compared to the content of the image that was printed on a given page in the processor 24. The comparison of the measured gloss pattern to the image content of the page enables identification of whether or not the gloss is as uniform as it should be.

Given knowledge of the diffuse and the specular components, one can determine the true specular reflection in situations where that is desirable. Since, there are two signals, one a measure of the diffusely reflected light and the other a measure of the specularly and diffusely reflected light, it is possible to extract the pure specular component when separate knowledge of the specular component is required. Knowing the angles of operation of the two illuminator-sensor combinations enables any angular dependence to be taken into account. For example, in the current disclosure, it is possible to measure the gloss level of customer images knowing the amounts of toner that have been laid down to print the image and to ensure uniformity.

Processor 24 removes the diffuse reflectance from the combination of the specular and diffuse reflectance by using algorithms. These algorithms are used for calculating the specular reflectance for each pixel, n, in the sensor(s) given at least one illuminator is aligned in a specular-reflectance relationship to a sensor and at least one illuminator is aligned in a diffuse-reflectance relationship to a sensor.

For the high resolution gloss measurement device, as shown in FIGS. 3 and 4, having two illuminators and one sensor, the specular reflectance for each pixel n is calculated by using the formula:

$$R_{S,n}=R_{SD,n}-\alpha_i\times R_{Di,n}$$

Where:

$R_{SD,n}$=signal at sensor from illuminator aligned in specular relation to a sensor for pixel n $R_{Di,n}$=signal at sensor from $i^{th}$ diffuse illuminator for pixel n $\alpha_i$=coefficient for $i^{th}$ diffuse illuminator For the high resolution gloss measurement device, as shown in FIG. 5, having one sensor and multiple illuminators, the specular reflectance for each pixel n is calculated by using the formula:

$$R_{S,n}=R_{SD,n}-(1/N)\times(\alpha_1\times R_{D1,n}+\alpha_2\times R_{D2,n}+\alpha_3\times R_{D3,n}+\ldots+\alpha_N\times R_{DN,n})$$

Where:

$R_{SD,n}$=signal at sensor from illuminator aligned in specular relation to a sensor for pixel n $R_{Di,n}$=signal at sensor from $i^{th}$ diffuse illuminator for pixel n $\alpha_i$=coefficient for $i^{th}$ diffuse illuminator For the high resolution gloss measurement device 25, as shown in FIG. 6, having two sensors and one illuminator, the specular reflectance for each pixel n is calculated by using the formula:

$$R_{S,n}=R_{SD,n}-\alpha_i\times R_{Di,n}$$

Where:

$R_{SD,n}$=signal at sensor from illuminator aligned in specular relation to a sensor for pixel n $R_{Di,n}$=signal at sensor from $i^{th}$ diffuse illuminator for pixel n $\alpha_i$=coefficient for $i^{th}$ diffuse illuminator In all above cases for the specular reflectance for each pixel n, normalization has been performed so the coefficient of $R_{SD}$=1. For all the above discussed cases, the interpolation may be performed to align the specular and diffuse signal to the diffuse signal(s).

A gloss factor, $F_G$ can be calculated by using the specular reflectance, $R_{S,n}$ for each pixel n. The gloss factor, $F_G$ depends on the marling material and substrate. The gloss factor, $F_G$ may be represented as a percentage of gloss, for e.g, 0-100%, or may be represented in some form of gloss metric. The gloss factor, $F_G$ may be a fixed target, such as test patches, or table of targets in non-volatile memory for various types images, etc, or user defined input. The gloss factor, $F_G$ may be calculated using the formula:

$$F_{G,n}=\beta\times R_{S,n},$$

Where:

$F_{G,n}$=gloss factor for each pixel n $\beta$=a function of marking material and substrate $R_{S,n}$=specular reflectance for each pixel n Noise can be reduced by averaging over as many pixels as possible, depending on the resolution required. Many applications can utilize a resolution well below 600 spi.

The processor 24 converts the high resolution gloss data 33 into a processed gloss data 34 for the object types with their locations. The processed gloss data 34 includes a measure of gloss over the page and gloss over the image content of the page, e.g., gloss for pictures is X, gloss over whole page is Y, or gloss over black text is Z, etc.

Once the gloss characteristic is determined, the gloss characteristic measured by the high resolution gloss measurement device 25 is compared to the image content 31 provided by print controller 21 corresponding to a desired output gloss. The difference between the gloss characteristic (e.g., what was actually printed) to the image content 31 (e.g., what should have been printed) produces an error signal. The error signal forms a basis of adjustment values used for modifying the process controls parameters of the marking engine to compensate for variations and inconsistencies in the output image.

The comparison between the gloss characteristic and the image content 31 is done in the processor 24. The comparison of the gloss may be done by a pixel by pixel basis or by a location. The comparison is used to calculate and generate an error signal if the values of the gloss characteristic measured by the high resolution gloss measurement device 25 and the image content 31 provided by print controller 21 differ.

In one embodiment, the process controls controller 23 sends commands 32 to the high resolution gloss measurement device 25 to trigger the high resolution gloss measurement device 25 to initiate the gloss measurement based on the comparison between the gloss characteristic measured by the high resolution gloss measurement device 25 and the image content 31 provided by print controller 21. The commands 32 from the process controls controller 23 closes a feedback loop to control at least one process controls parameter of the marking engine based on comparison of the gloss characteristic measured by the high resolution gloss measurement device 25 with the image content 31 provided by print controller 21 and, thus, enabling identification of whether or not the gloss is as uniform as it should be.

The processed gloss data 34 for the object types with their locations is sent to the process controls controller 23. The process controls parameters of the marking engine are controlled by the process controls controller 23 based on the comparison of the gloss characteristic measured by the high resolution gloss measurement device 25 with the image content 31 provided by print controller 21. If a difference between measured gloss characteristic and desired gloss characteristic (i.e., image content) is detected, the process controls controller 23 is configured to send commands 35 to the process controls actuators 26 to control the process controls actuators 26 to achieve the desired gloss levels. The process controls actuators 26 associated with the marking engine are adjusted to effect image quality parameters, such as the gloss, in the marking engine based on the output 34 from the processor 24. The process controls parameters of the marking engine that are adjusted to compensate for variations and inconsistencies in the output image may be selected from a group consisting of fuser roll temperature, dwell time in the fuser roll nip, process speed, additional heat energy supplied, nip width of the fuser roll nip and pressure on the fuser rolls.

In one embodiment, the process controls controller 23 sends a status signal 36 indicating that a failure has occurred and the desired gloss is not achieved, the marking engine controller 22 then reprints the document after the necessary corrections have been made to adjust the desired gloss levels. In another embodiment, the process controls controller 23 sends a handshake signal along with the status signal 36. The handshake signal confirms that the data 31 is received by the process controls controller 23 and the process controls controller 23 is ready for accept the next packet of data 31 from the marking engine controller 22.

With the knowledge of the processed gloss data 34 from the processor 24, the process controls actuators 26 which effect achieved gloss levels may be advantageously controlled by the process controls controller 23. For example, fuser roll temperature and dwell time in the fuser roll nip typical of the fusing systems may be readily adjusted with, additional heat energy applied or process speed. In one embodiment, the process controls actuators 26 may be, for example, an actuator for the fuser roll heater. Since gloss generally increases with increasing fuser roll temperature, a low gloss measurement may be addressed by increasing the fuser roll temperature, and vice versa. Other factors which affect gloss include pressure on the fuser rolls, and nip width of the fuser roll nip, which may be alternatively or additionally controlled to achieve a desired gloss level. The nip width and the process speed together determine the dwell time.

In one embodiment, the processor 24 may be an individual processor or multiple processors with the different functions (i.e., receiving the image content 31; processing the detected generally specular and diffuse reflectances; and comparing the gloss characteristic and image content) distributed among them.

In an embodiment, instead of determining the gloss level of the images automatically by a sensor with an automated feedback loop, the gloss level is determined manually. A manual override that increases or decreases the tolerance windows can be used to adjust the gloss. In one embodiment, the marking engine is provided with a temperature adjustment actuator for the fuser, such as a knob, which is adjusted by the operator. The temperature adjustment actuator allows an operator (or the process controls controller 23 in an automated system) to make a limited adjustment to the temperature which is in a predetermined range of acceptability between a minimum level determined to give an acceptable fix and a maximum level which does not cause damage to the fuser. It is to be noted that in some instances the gloss may be uniform but may not be within the absolute desired levels due to document type and/or settings. In such instances the user may provide appropriate input to maintain the gloss within the absolute desired levels.

While the illustrated embodiment shows the image printing system 200 for determining the gloss quality of an image, it will be understood that other sensors may be used. Image quality parameters such as registration, halftone characteristics, line width, color reproduction and other properties may be detected by the appropriate sensors.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. An image printing system configured for adjusting gloss on printed documents, the system comprising:

a marking engine constructed to print images on a document, the printed images having gloss, a gloss measurement device comprising:

(i) one or more illuminators configured to emit one or more light beams at the printed document, thereby producing generally specular reflectance and generally diffuse reflectance at least in a first reflectance direction; and (ii) a linear array sensor configured to detect the generally specular reflectance and the generally diffuse reflectance in the first reflectance direction;

a processor configured to:

(a) receive image data relating to a content of the image to be printed on the document;

(b) determine the generally specular reflectance by removing the generally diffuse reflectance from the generally specular reflectance;

(c) determine a characteristic of the gloss of the document using the determined generally specular reflectance; and (d) compare the gloss characteristic with the image data relating to the content of the image printed on the document; and a controller configured to control at least one process controls parameter of the marking engine based on the comparison of the gloss characteristic with the image content by the processor.

2. The system of claim 1, wherein the image content of the document comprises object types and their locations.

3. The system of claim 2, wherein the object types comprise saturated colors, solids, halftone regions and substrate.

4. The system of claim 2, further comprises an interface configured to connect with a network and the marking engine and to identify the object types and their locations on the document to be printed.

5. The system of claim 4, wherein a user may input a desired gloss to the interface, where the input may be selected from the group consisting of a job ticket and a scanned document.

6. The system of claim 1, wherein the controller adjusts at least one process controls actuator to control the at least one process controls parameter.

7. The system of claim 1, wherein the at least one process controls parameter may be selected from the group consisting of fuser roll temperature, dwell time in fuser roll nip, process speed, additional heat energy supplied, nip width of the fuser roll nip and pressure on the fuser rolls.

8. The system of claim 1, wherein the linear array sensor is a full width array (FWA) sensor, contact image sensor, a CMOS array sensor or a CCD array sensor.

9. The system of claim 1, wherein the illuminator comprises at least one of the group consisting of: a linear LED array, a lamp, a lamp with a reflector, and a collimated light source.

10. The system of claim 1, wherein the generally specular reflectance in the first direction includes some diffuse reflectance.

11. The system of claim 1, wherein the marking engine is configured to reprint the document based on a signal received from the processor.

12. The system of claim 1, wherein the gloss measurement device is provided downstream of the marking engine.

13. The system of claim 1, wherein the one or more illuminators include one or more illuminators oriented in a first emission direction to produce the generally specular reflectance in the first reflectance direction and one or more illuminators oriented in a second emission direction to produce the generally diffuse reflectance in the first reflectance direction, wherein an angle between the first emission direction and an axis normal to the printed document and an angle between the first reflectance direction and the normal axis are symmetrical, and wherein an angle between the second emission direction and the normal axis and the angle between the first reflectance direction and the normal axis are asymmetrical.

14. The system of claim 13, wherein the generally specular reflectance for each pixel n is determined according to the equation:

$$R_{S,n}=R_{SD,n}-\alpha_i\times R_{Di,n}$$

where:

$R_{S,n}$= the determined generally specular reflectance for each pixel n;

$R_{SD,n}$= the generally specular reflectance for each pixel n;

i= number of the illuminators oriented in an emission direction other than the first emission direction;

$R_{Di,n}$= the generally diffuse reflectance for each pixel n for $i^{th}$ illuminator; and $\alpha_i$= coefficient for $i^{th}$ illuminator oriented in an emission direction other than the first emission direction.

15. The system of claim 14, wherein the gloss characteristic for each pixel n is determined according to the equation:

$$F_{G,n}=\beta\times R_{S,n}$$

where:

$F_{G,n}$=the gloss characteristic for each pixel n;

β=a function of marking material and bare document; and $R_{S,n}$=the determined generally specular reflectance for each pixel n.

16. The system of claim 1, wherein the linear array sensor is a first linear sensor array configured to detect the generally specular reflectance produced by the one or more light beams in a first emission direction, and further comprising a second linear array sensor configured to detect the generally diffuse reflectance in a second reflectance direction;

wherein an angle between the first emission direction and an axis normal to the printed document and an angle between the first reflectance direction and the normal axis are symmetrical, and wherein the angle between the first emission direction and the normal axis and an angle between the second reflectance direction and the normal axis are asymmetrical.

17. A method for adjusting gloss on printed documents, the method comprising:

printing images on a document using a marking engine, where the printed images have gloss;

providing a gloss measurement device;

configuring one or more illuminators of the gloss measurement device to emit one or more light beams at the printed document, thereby producing generally specular reflectance and generally diffuse reflectance at least in a first reflectance direction;

configuring a linear array sensor to detect the generally specular reflectance and the generally diffuse reflectance in the first reflectance direction;

providing a processor configured to:

(a) receive image data relating to a content of the image to be printed on the document;

(b) determine the generally specular reflectance by removing the generally diffuse reflectance from the generally specular reflectance;

(c) determine a characteristic of the gloss of the document using the determined generally specular reflectance; and (d) compare the gloss characteristic with the image data relating to the content of the image printed on the document; and providing a controller configured to control at least one process controls parameter of the marking engine based on the comparison of the gloss characteristic with the image content by the processor.

18. The method of claim 17, wherein the image content of the document comprises object types and their locations.

19. The method of claim 18, wherein the object types comprise saturated colors, solids, halftone regions and substrate.

20. The method of claim 18, further comprises providing an interface configured to connect with a network and the marking engine and to identify the object types and their locations on the document to be printed.

21. The method of claim 20, wherein a user may input a desired gloss to the interface, where the input may be selected from the group consisting of a job ticket and a scanned document.

22. The method of claim 17, wherein the controller adjusts at least one process controls actuator to control the at least one process controls parameter.

23. The method of claim 17, wherein the at least one process controls parameter may be selected from the group consisting of fuser roll temperature, dwell time in fuser roll nip, process speed, additional heat energy supplied, nip width of the fuser roll nip and pressure on the fuser rolls.

24. The method of claim 17, wherein the linear array sensor is a full width array (FWA) sensor, contact image sensor, a CMOS array sensor or a CCD array sensor.

25. The method of claim 17, wherein the illuminator comprises at least one of the group consisting of: a linear LED array, a lamp, a lamp with a reflector, and a collimated light source.

26. The method of claim 17, wherein the generally specular reflectance in the first direction includes some diffuse reflectance.

27. The method of claim 17, wherein the marking engine is configured to reprint the document based on a signal received from the processor.

28. The method of claim 17, wherein the gloss measurement device is provided downstream of the marking engine.

* * * * *